United States Patent [19]

Rau et al.

[11] 4,307,690

[45] Dec. 29, 1981

[54] ELECTRONIC, VARIABLE SPEED ENGINE GOVERNOR

[75] Inventors: James E. Rau, Anaheim; Rogell VanWyk, Brea, both of Calif.

[73] Assignee: Rockwell International Corporation, El Segundo, Calif.

[21] Appl. No.: 156,728

[22] Filed: Jun. 5, 1980

[51] Int. Cl.[3] ..... F02D 11/10

[52] U.S. Cl. ..... 123/353; 123/352; 180/179; 290/40 R; 361/431

[58] Field of Search ..... 123/352–356; 180/176–179; 290/40 R, 40 A, 40 B, 40 C, 40 F; 364/431

[56] References Cited

U.S. PATENT DOCUMENTS

| | | | |
|---|---|---|---|
| 3,998,191 | 12/1976 | Beterlein et al. | 180/176 X |
| 4,138,723 | 2/1979 | Nehmer et al. | 180/179 X |
| 4,245,599 | 1/1981 | Des Lauriers | 123/353 |
| 4,249,119 | 2/1981 | Robbi | 180/179 X |

*Primary Examiner*—Tony M. Argenbright

*Attorney, Agent, or Firm*—H. Fredrick Hamann; Rolf M. Pitts; Edward A. Sokolski

[57] ABSTRACT

A speed regulator or governor for an engine. The governor utilizes the approximate digital equivalent of a lead and a lag feedback network in combination with a stored, digital, nonlinear look-up table, or other nonlinear means, to control engine speed. The governor controls the engine at different fixed engine speeds in response to demand, or at continuously variable engine speeds in response to demand.

9 Claims, 8 Drawing Figures

LEAD - FORMS RPM RATE OF CHANGE BY:
RATOUT ← RPM - RPMOLD
RPMOLD ← RPM

LAG1 - UPDATES THE DOUBLE PRECISION VALUE OF LAGØ BY
DELTA Δ ← 2161 · RPME - LAGØ
LAGØ ← LAGØ + DELTA/256

ELECTRONIC, VARIABLE SPEED ENGINE GOVERNOR

BACKGROUND OF THE INVENTION

1. Field of the Invention

This invention pertains to automatic devices for the control or regulation of engine speed. Such automatic devices are commonly referred to as "governors". More particularly, this invention pertains to governors for the automatic control of engine speed where the desired engine speed varies with time. The desired engine speed may vary either in a stepwise fashion or in a continuous manner as a function of time.

2. Description of the Prior Art

Simple mechanical governors that cause an engine to operate at a fixed speed are well known in the art. However, when a load is applied to an engine that is controlled by a simple mechanical governor, the speed or rate of rotation of the engine sags or decreases significantly below the no-load rpm. If the mechanical sensitivity of the governor to changes in rpm is increased in an attempt to reduce the sag in rpm with load, the engine and control mechanism tends to become unstable. Digital electronic control of engine speed allows the introduction of nonlinear processing techniques to obtain accurate control of engine rpm that exhibits little sag with load and at the same time also avoids engine instability. A digital electronic control system also can be used to vary the engine speed in a predetermined manner in response to varying demands on the engine.

SUMMARY OF THE INVENTION

This invention is an improved apparatus for automatically controlling the speed of an engine, the engine having an actuator controlled throttle and having means for sensing the speed of the engine. In the application described here, the engine is used to drive a generator, which in turn is used either to provide welding current or to supply power in the form of alternating current at 60 Hz. The invention determines a desired engine speed or rpm from a combination of sensors. A two-position state switch, which is placed in the appropriate position by the operator, indicates whether the generator is to be used for welding or for supplying 60 Hz power. Current sensors indicate when the generator is supplying current in the welding application or AC power at 60 Hz. This invention combines the inputs from these sensors to determine the desired speed or rpm of the engine in accord with preset logic. When no current is being drawn from the generator, the desired engine speed is low so as to conserve fuel, and to reduce engine wear and noise. When welding current is drawn, the desired engine speed is high so that the engine can supply sufficient power without stalling. The desired engine speed remains high for a period of ten or so seconds after the welding current has dropped to zero so as to avoid having the engine speed drop back to idle during the period of time required for the welder to replace a welding rod and resume welding.

When 60 Hz current is drawn, the desired engine speed is that speed required to produce alternating current at 60 Hz.

The desired rpm is compared with the actual rpm of the engine and the difference is used in this invention to generate a command for a throttle actuator which in turn operates to cause the engine to operate at the desired speed.

This invention utilizes the digital equivalent of a lag feedback network and, in the preferred embodiment, additionally a lead feedback network. This invention also utilizes digital processing to alter the effective values of the lead and lag components in these feedback networks, and, in the preferred embodiment, a stored, nonlinear table of numbers to generate a throttle actuator command to control the throttle actuator.

DESCRIPTION OF THE PREFERRED EMBODIMENT

Figures 1, 6:
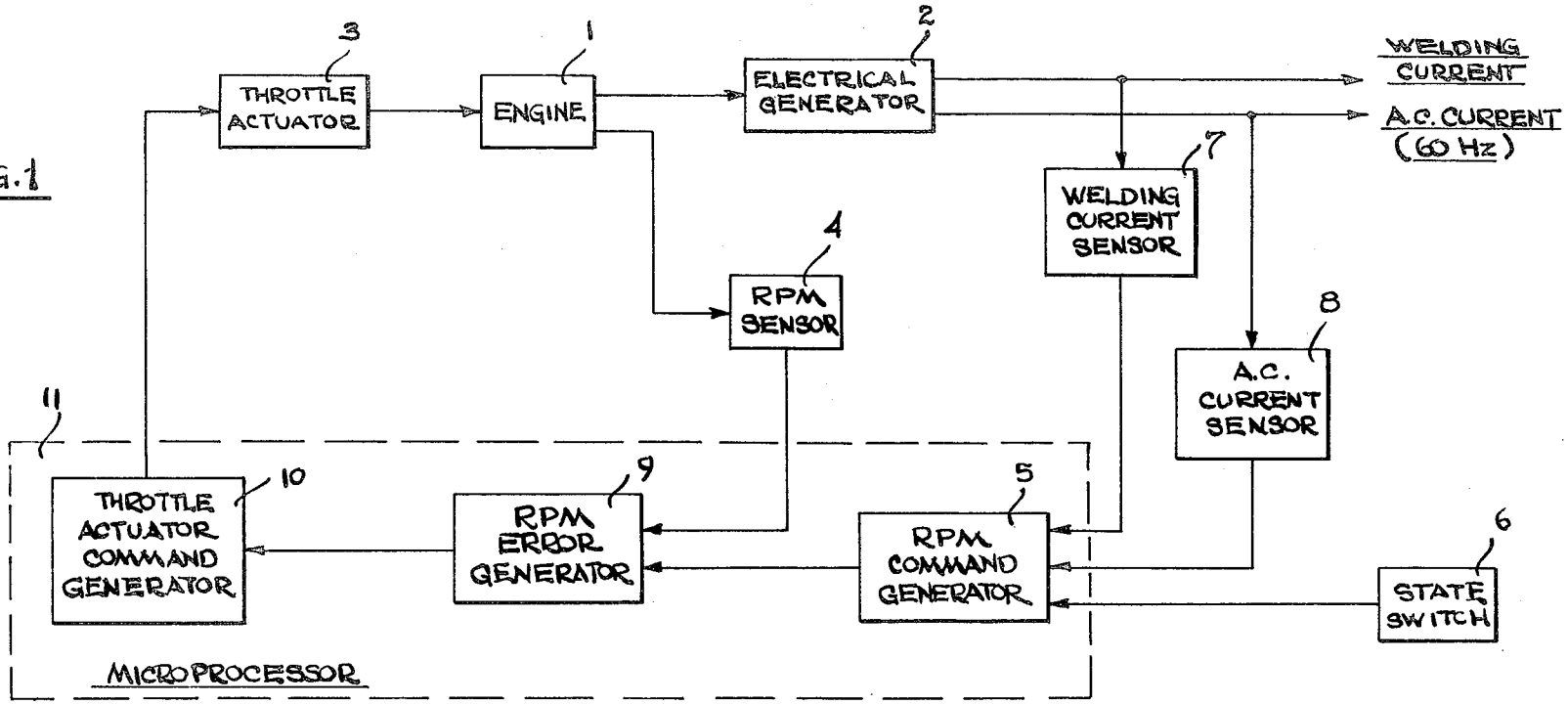
FIG. 1 is a block diagram of the invention.
FIG. 6 lists certain of the computational functions referred to in the flow diagram.

Referring now to FIG. 1. In the preferred embodiment, engine 1 is a gasoline or diesel reciprocating engine. The use of this invention, however, is not limited to such engines but can be used with respect to any engine whose operation is controlled by a throttle or similar device. Engine 1 drives electrical generator 2, which in turn supplies electrical current to a welding rod in welding applications, or delivers 60 Hz alternating power in those applications were electrical generator 2 is used as an AC power source. The practice of this of this invention, however, is not limited to systems for welding or for power generation since the invention could be used in most applications where automatic control of engine speed is desired.

At any instant the speed of engine 1 is determined by the load on the engine from electrical generator 2, the throttle position as determined by a throttle actuator 3, the prior speed of the engine, and various other factors such as the spark timing in the case of a gasoline engine. The speed of the engine at each moment is measured by rpm sensor 4, and output by rpm sensor 4 as a digital number.

Figure 8:
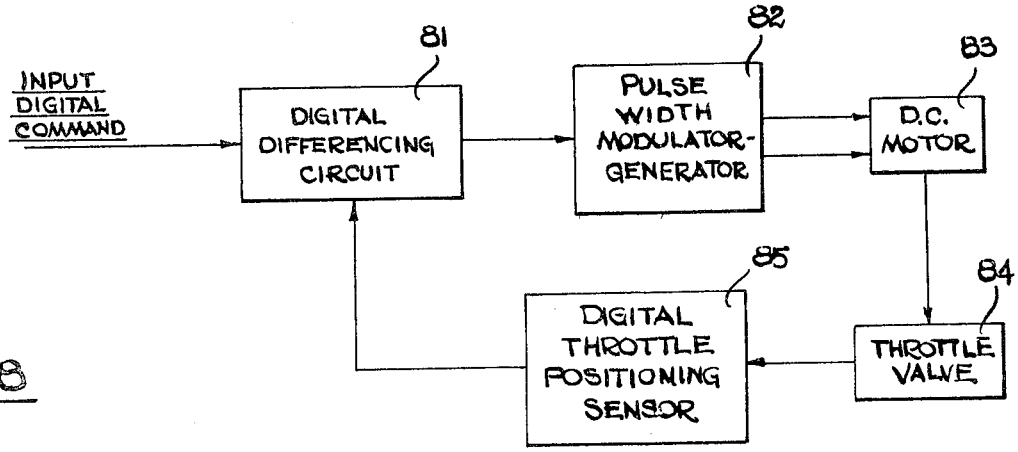
FIG. 8 is a block diagram of a digital servomechanism that could be used as a throttle actuator.

Throttle actuator 3 may be any of the well-known digital servo-mechanisms for translating digital electrical signals into mechanical throttle rotation. For instance, the digital servo-mechanism could consist of the combination of the devices described in the block diagram in FIG. 8. Referring now to FIG. 8, the mechanical position of throttle valve 84 is sensed and output as a digital number by digital throttle positioning sensor 85. The digital representation of the throttle valve position is compared with the digital command from throttle actuator command generator 10 of FIG. 1, in the digital differencing circuit 81 in FIG. 8. The digital differencing circuit could be a special purpose logic network constructed for this purpose alone, or it could be implemented by means of a short routine in a digital computer. The microprocessor 11 of FIG. 1 could, of course, be used for this purpose. The digital number output by digital differencing circuit 81, which represents the difference between the actual throttle valve position and the position commanded by throttle actuator command generator 10 of FIG. 1, is input into pulse width modulator and generator 82. The pulse width modulator and generator 82 generates two sets of pulses whose widths are modulated in accord with the input. The two strings of pulses are connected to be opposite ends of the armature winding of DC motor 83. The armature of DC motor 83 is connected mechanically by gears to throttle valve 84 so that its operation causes the position of throttle valve 84 to change in accord with the rotation of the armature of DC motor 83. During the "on" period of each pulse, the end of the armature of the DC motor 83 to which the pulse is connected is effectively connected to a power source voltage and during the "off" period of the pulse the end of the armature effectively is connected to ground. As a consequence, when the pulses in the two trains are of equal length and coincide in time, both ends of the armature winding of DC motor 83 are at the same time effectively connected to ground or to the power supply so that no current flows through the armature and the armature remains stationary. However, whenever the width of one sequence of pulses exceeds the width of the pulses in the other series in response to a digital error signal from digital differencing circuit 81, one end of the armature is in effect connected to ground and the other to the power supply for short periods of time, thus causing the armature to rotate and change the position of throttle valve 84. The rotation direction is dependent upon which series of pulses is the longer.

Referring now to FIG. 1, rpm sensor 4 may be any of a number of well-known devices for measuring the speed of an engine and for outputting the speed as a digital number.

In the application described here, the rpm command generator 5 receives inputs from a state switch 6, a welding current sensor 7, and an AC current sensor 8. State switch 6 is a simple two-position switch by which the user of the invention indicates whether electrical generator 2 is being used for welding or as a source of electrical power at 60 Hz.

Welding current sensor 7 is a bi-state sensor which signals whether current is flowing from the welding output of electrical generator 2. AC current sensor 8 is a two-state sensor which indicates whether AC power is flowing from the electrical generator 2. Sensors 7 and 8 are simple current operated mechanical relays or instead could be functionally equivalent, bi-state electronic sensors.

In applications where the electrical generator is used to supply only welding current, or only AC current, the state switch 6 can be eliminated and either the welding current sensor 7 or the AC current sensor 8 eliminated from the preferred embodiment of the invention. In an application where the desired engine rpm is the same for the generation of welding current, as it is for the generation of AC current, the state switch 6 again can be elminated, although both current sensors would be retained to sense current demand and to cause the engine to speed up to the desired engine speed whenever AC current or welding current is drawn from electrical generator 2.

In still a different application, when the "idle" speed is the same as the desired engine speed for the generation of AC current and a higher speed is desired for the production of welding current, the AC current sensor 8 can be eliminated, and the state switch 8 replaced by a manual or automatic switch which disables the AC output from electrical generator 2 whenever the electrical generator 2 is used to supply welding current. AC current sensor 8, welding current sensor 7 and power weld switch 7 operate as "demand sensors".

Rpm command generator 5 processes the inputs it receives from state switch 6, welding current sensor 7 and AC current sensor 8 to determine for each instant the desired speed of engine 1 and outputs this desired speed as an rpm command.

Rpm error generator 9 compares the output of rpm sensor 4, which indicates the speed of engine 1, with the output of rpm command generator 5, which indicates the desired speed of the engine, determines the difference between these inputs and outputs this difference as an rpm error to throttle actuator command generator 10. Throttle actuator command generator 10 processes the present and the past values of rpm error to generate a throttle actuator command which, in turn, is input to throttle actuator 3 which controls the position of the throttle in engine 1.

In the preferred embodiment, throttle actuator command generator 10 utilizes digital processing to simulate approximately the operation of lead and lag feedback networks, together with a stored nonlinear look-up table to generate the throttle actuator commands. In some applications, however, a simulated lead network need not be included to obtain satisfactory operation of the invention as a governor. Because of the flexibility of digital processing, throttle actuator command generator 10 is able, in effect, to alter the feedback parameters from time to time in response to its input so as to better control the operation of engine 1.

In the preferred embodiment, a single microprocessor, shown in FIG. 1 as microprocessor 11, programmed in accord with this specification operates as the combination of rpm command generator 5, rpm error generator 9, and throttle actuator command generator 10. Microprocessor 11 can be any of a number of different microprocessors such as the Motorola MC6800, the MOS Technology MCS6502, and the Intel 8080, which are readily available, off-the-shelf items. The preferred embodiment, however, utilizes the Rockwell R6500 Microprocessor.

Figure 2:
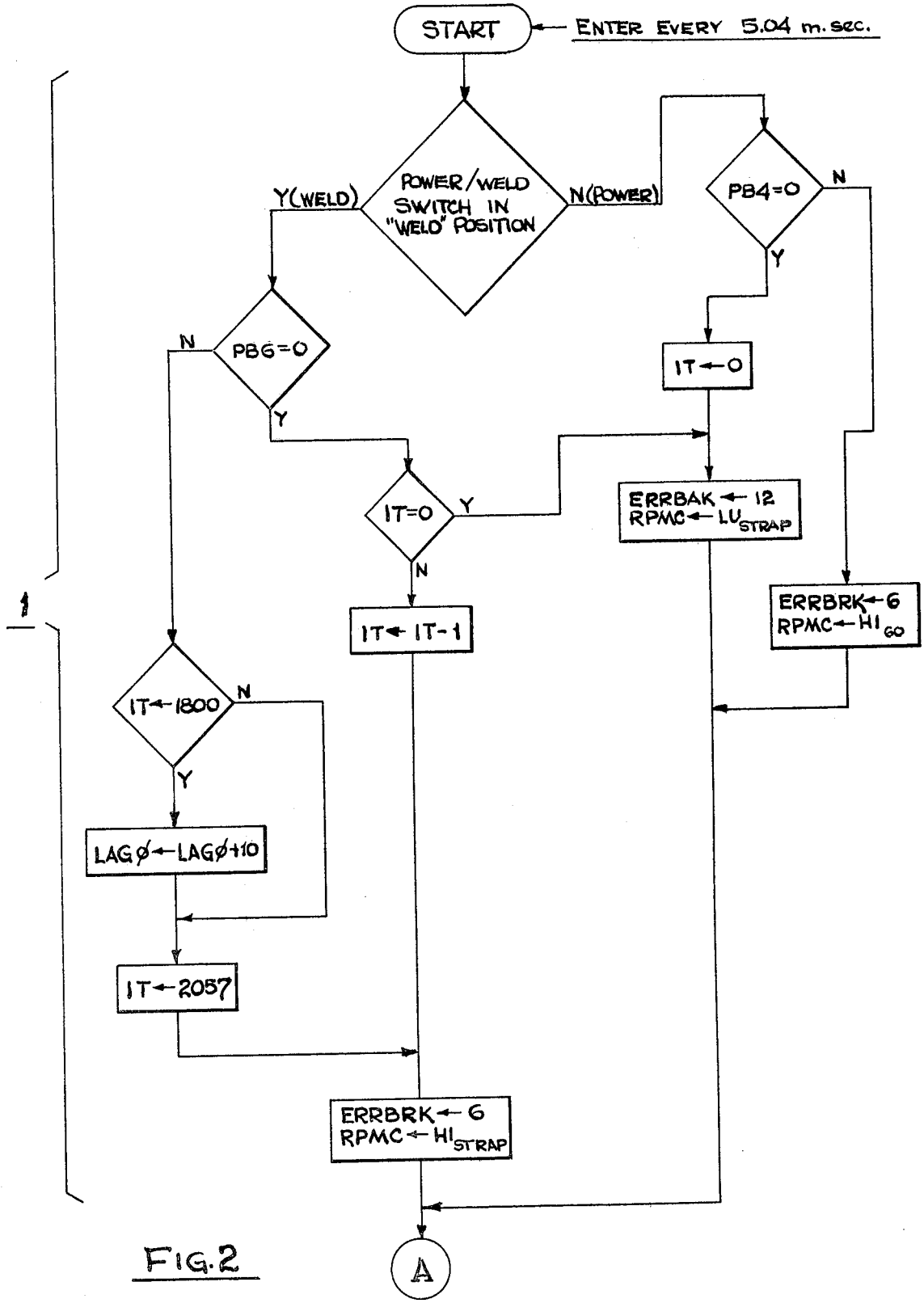
FIGS. 2–5 contain a flow diagram that describes the operation of the microprocessor that is utilized as part of this invention.

FIGS. 2, 3, 4 and 5 contain a flow diagram which describes the operation of microprocessor 11 and the manner in which microprocessor 11 is programmed to practice the invention. Referring now to FIG. 2. In the preferred embodiment, microprocessor 11 executes the series of operations depicted in FIGS. 2–5 beginning at "start" at the top of FIG. 2 every 5.04 milliseconds. As illustrated by the flow diagram, if the power/weld switch, i.e., the state sensor switch 6, is in the "power" position, the microprocessor then asks if PB4 is equal to "0". PB4 represents the state of the AC current sensor 8 and is "0" if no AC current is being delivered by generator 2. If PB4 equals "0", IT is set equal to "0", ERRBRK is set equal to 12, and RPMC is set equal to $LO_{STRAP}$.

The meanings of IT and ERRBRK will be explained below. RPMC is the desired rpm that is output by rpm command generator 5 and, under the circumstances described above, is set equal to $LO_{STRAP}$, the desired engine speed when neither welding current nor AC current is being drawn from generator 2. For an idle speed of 1200 rpm on a 4-cylinder engine, $LO_{STRAP}$ is 116. If AC current is being drawn from generator 2, then PB4 is not equal to "0" and ERRBRK is set equal to a non-zero constant, in this case, "6", and RPMC is set equal to $HI_{60}$, the desired engine speed to drive the generator so as to deliver alternating current at 60 Hz.

For a speed of 1800 rpm for a 4-cylinder engine, $HI_{60}$ is 177 in this embodiment. The actual values of $LO_{STRAP}$ and $HI_{60}$ in each application will depend on the desired engine idle speeds and the engine speeds at which AC power of welding current is to be produced. These values also must be adjusted to correspond to the numerical values output by rpm sensor 4 at idle and at power or welding engine speeds.

If the power/weld switch is in the "weld" position, the microprocessor 11 tests to see if PB6 is equal to "0". PB6 represents the output of welding current sensor 7 and is "0" if no welding current is being drawn. If PB6 is equal to "0", the microprocessor 11 tests to see if IT is less than a preset constant, 1800, which corresponds to a timed interval of approximately 9 seconds and, if true, then sets LAG$\phi$ equal to the previous value of LAG$\phi$, +10. IT is then set equal to a constant, 2057 which corresponds to a time interval of approximately 10 seconds, ERRBRK is set equal to 6, and RPMC is set equal to $HI_{STRAP}$.

"IT" is a dummy, stored number that operates as a "hold" to maintain the engine speed at the desired welding speed for a period of time, determined by the constant, which, in this case gives a delay of approximately 10 seconds after the welding current has gone to zero, in order to allow the person using the welding machine time enough to insert a new welding rod without causing the engine speed to drop back to idle; that is, to the speed determined by $LO_{STRAP}$. The test whether IT is less than 1800 inserts a jump in the value of LAG$\phi$ whenever welding begins and welding current is first drawn so as to cause the engine to speed up quickly in response to the sudden change of LAG$\phi$. Thus, whenever the welding current has been zero for more than one second (the difference between 10 seconds (IT=2057) and 9 seconds (IT=1800)), the restarting of welding current causes LAG$\phi$ to be replaced by LAG$\phi$+10. Of course, if welding stops and then begins again in less than 10 seconds, the engine speed has remained at the speed required for welding. However, if the welding current has been zero for more than one second, LAG$\phi$ is replaced by LAG$\phi$+10 when the welding current is again drawn, which causes the throttle to open momentarily to counteract the effect of the sudden reapplication of load to motor and generator.

If the welding current PB6 is equal to zero, then IT is tested to see if IT also is equal to zero. If IT is not, IT is reduced by 1 and RPMC remains at the value given by $HI_{STRAP}$. After successive tests of PB6 in which all are "0", IT is finally reduced to "0", at that point ERRBRK is set equal to 12, and RPMC is set equal to $LO_{STRAP}$, thus dropping the command rpm back down to the value at idle. Part 1 of the flow diagram in FIG. 2 describes the manner in which microprocessor 11 operates as the rpm command generator 5.

Figure 3:
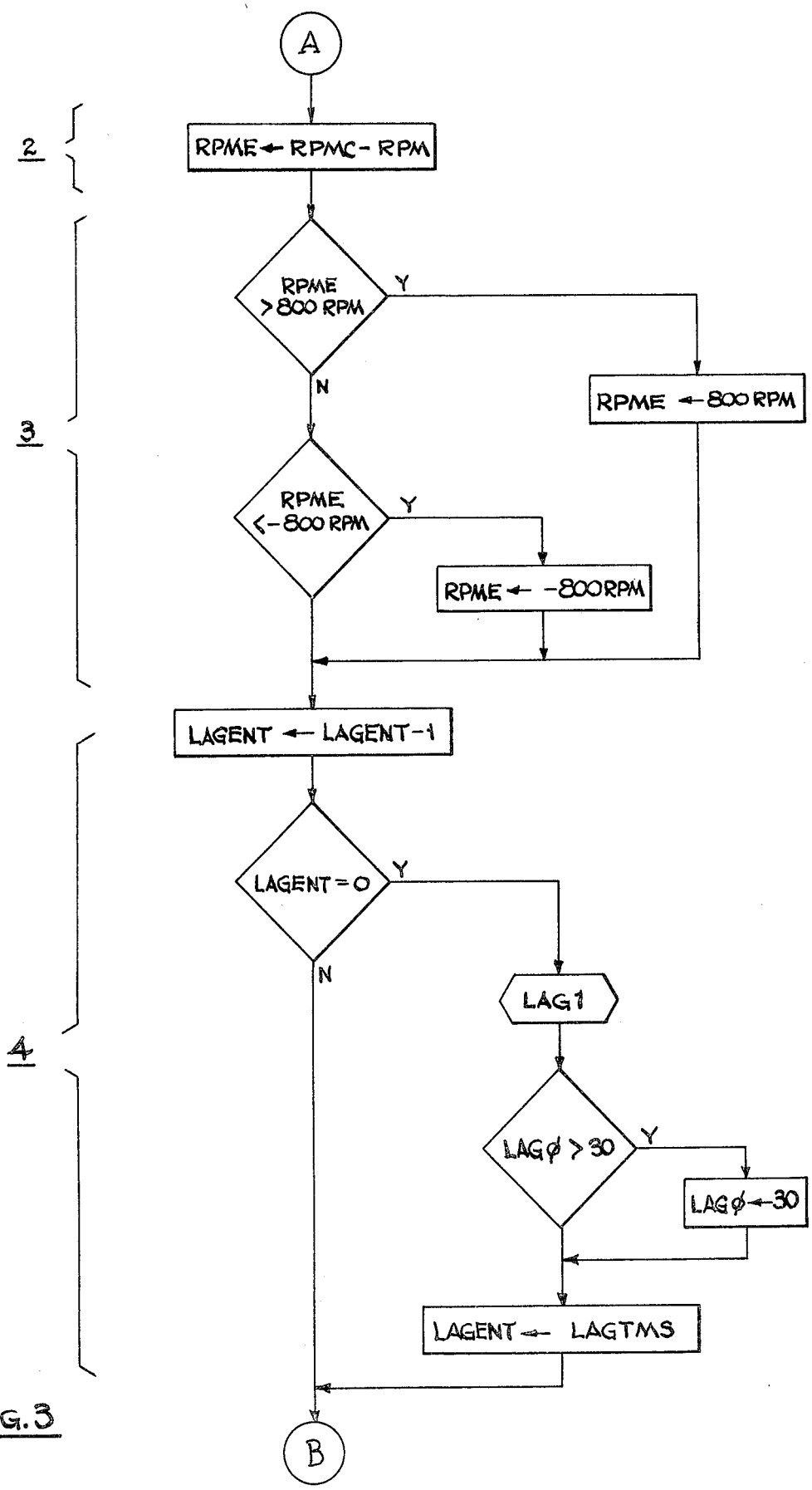

Referring now to FIG. 3. At part 2 of the flow diagram, microprocessor 11 performs the functions of rpm error generator 9 by calculating RPME as given by RPMC−RPM. RPME is the difference between the desired and the actual speed of the engine. The desired speed is represented by RPMC and the actual speed is represented by RPM.

The operations depicted in part 3 of the flow diagram limit the absolute magnitude of RPME so as not to cause overflow or underflow in the succeeding digital operations.

Part 4 of the flow diagram performs operations that are approximately equivalent to the operation of a lag feedback network. LAGENT is a dummy variable which causes the operation represented by LAG1 to be executed only once for each LAGTMS times that the microprocessor enters this portion of the flow diagram. LAG1 performs the operation represented by the following equations:

$$\text{Delta} \leftarrow 2^{IG1} \times \text{RPME} - \text{LAGO}\phi$$

$$\text{LAG}\phi \leftarrow \text{LAG}\phi + \text{Delta}/256$$

$2^{IG1}$ is a multiplicative constant that is a power of 2 and is given effect by a left shift within the microprocessor. The analog equivalent of the digital operation performed by LAG1 is an operational amplifier with an RC feedback network having a transient response to a step input of size, RPME, given by the following equation:

$$\text{LAG}\phi = 2^{IG1} \times \text{RPME}\,(1 - e^{-t/\lambda})$$

where $\lambda = 1.29$ LAGENT seconds.

Figure 4:
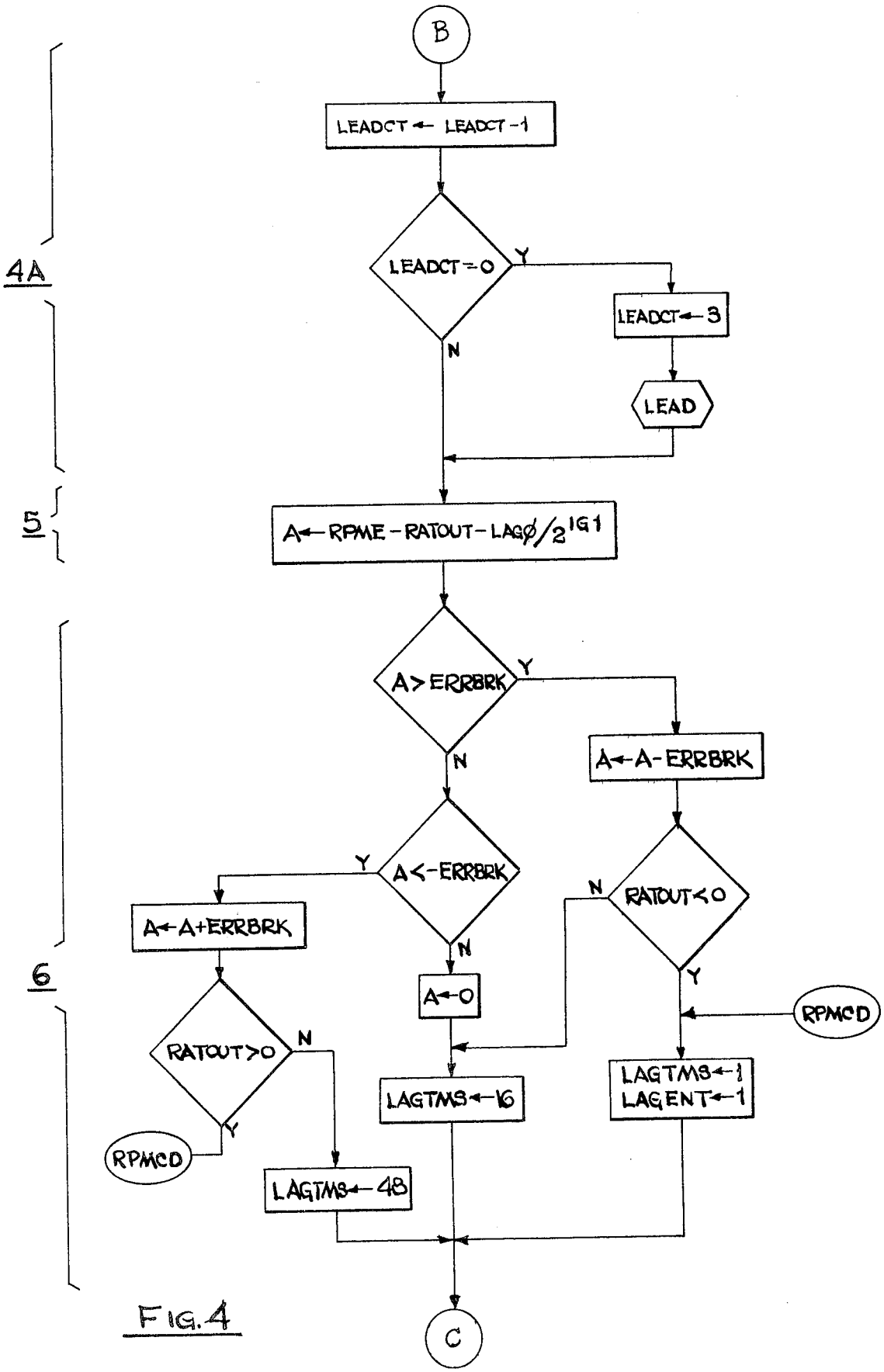

Referring now to FIG. 4 and part 4A of the flow diagram. LEADCT is a dummy counter that causes the operation represented by LEAD to be executed once every three times that the microprocessor traverses the flow diagram. The operation represented by LEAD calculates the rate at which the speed or rpm of the engine is changing as given by the following equations:

$$\text{RATOUT} \leftarrow \text{RPM} - \text{RPMOLD}$$

$$\text{RPMOLD} \leftarrow \text{RPM}$$

RATOUT represents this rate of change in engine speed.

In part 5 of the flow diagram, microprocessor 11 calculates the value of A, referred to here as the intermediate digital control number, as given by RPME−RATOUT−LAG$\phi/2^{IG1}$. Thus, RATOUT, the rate of change of the speed of the engine, is subtracted from RPME in the manner of a lead network so as to give stability to the control system. Because, at steady-state, LAG$\phi$ approaches $2^{IG1} \times$RPME, then at steady-state A also approaches "0".

When the system is operating near to steady-state and the absolute value of A is less than ERRBRK, the operations depicted in part 6 of the flow diagram set A equal to "0" and LAGTHMS equal to 16 so that the value of LAG$\phi$ is altered by the operation represented by LAG1 only once in every 16 passes through the flow diagram, thus, in effect, giving a long time constant to the lag network. Also, when A is set equal to "0", the effective gain of the control system is reduced.

If A exceeds, positively, the value of ERRBRK, which typically would happen if the engine speed was less than the desired speed, and the engine speed was increasing towards the desired rpm such that RATOUT is not less than "0", then A is not set to "0", causing the feedback gain to be high. LAGTHMS again is set to 16. If A exceeds ERRBRK and the engine speed is decreasing such as might occur when a heavy load is suddenly applied, LAGTMS is set equal to 1 and LAGENT is set equal to 1, thus, in effect, greatly reducing the time constant of the lag network so that LAG$\phi$ will increase rapidly in size and cause the throttle to open rapidly to compensate for the increased load.

On the other hand, if A is less than −ERRBRK, as would occur if the engine speed were too high and the engine speed is still increasing, as might occur when the load is reduced suddenly, then LAGTMS again is set equal to 1 and LAGENT is set equal to 1, reducing the time constant LAG$\phi$ so that LAG$\phi$ can change rapidly, causing the throttle to close and reduce the engine speed to the desired rpm. A value of 6 for ERRBRK corresponds to an incremental value of 70 rpm, and the value of 12 corresponds to 140 rpm.

However, when the engine speed is too high and the engine speed is decreasing, as indicated by RATOUT being less than "0", LAGTMS is set equal to 48. As a consequence, the time constant of the lag network, in such circumstances, is significantly increased, thus causing the engine speed to decrease very slowly towards the desired rpm. Part 6 of the flow diagram also contains operations which cause A to be replaced by either A$\pm$ERRBRK. The purpose of these operations is to eliminate step discontinuities in the value of A that otherwise would occur as a consequence of A being set to "0" whenever its absolute value is less than ERRBRK.

Figure 5:
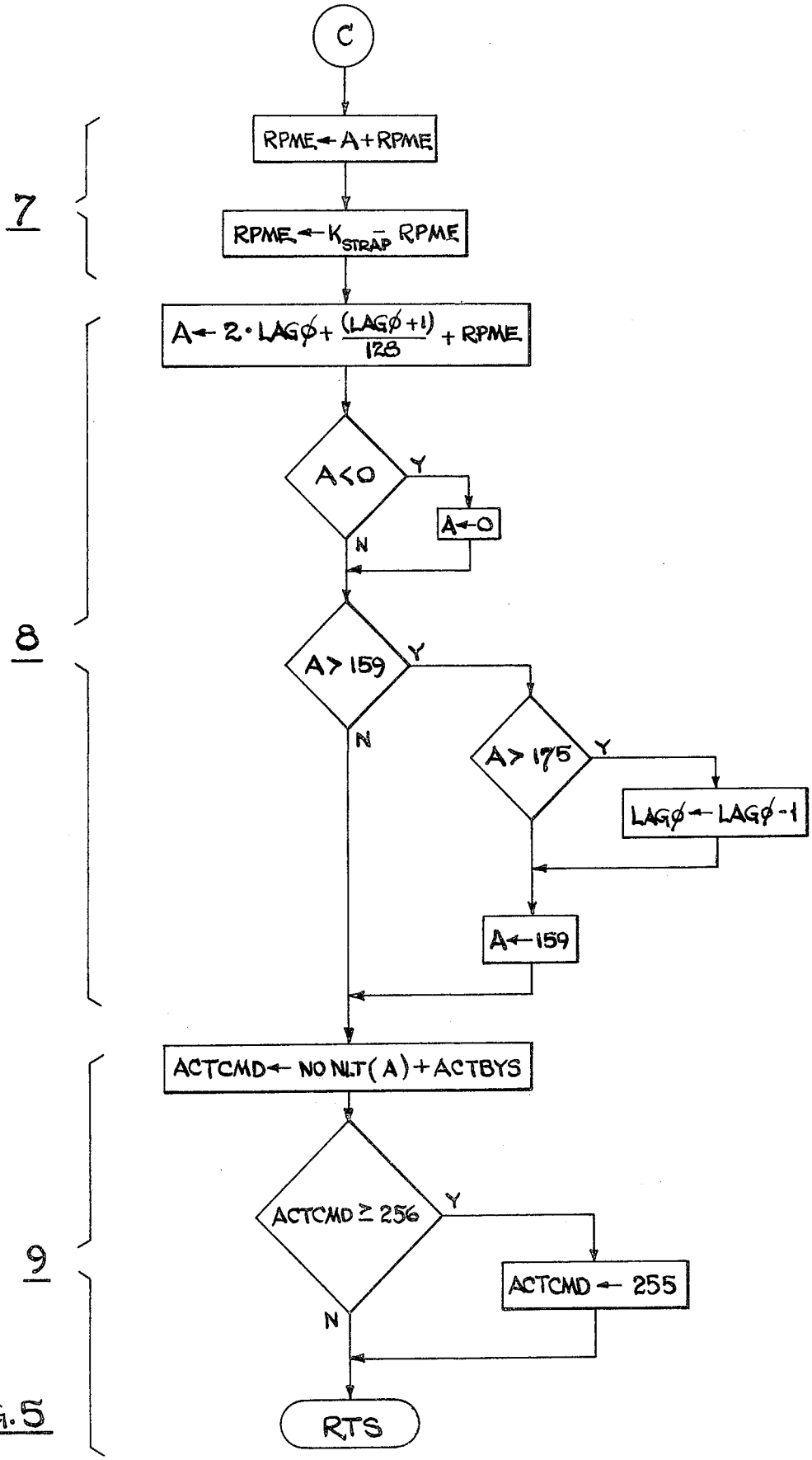

Referring now to FIG. 5. The steps indicated in part 7 of the flow diagram combine A with the previously computed value of RPME and then multiply the result by the constant $K_{STRAP}$, which constant is selected to obtain good performance without instability. $K_{STRAP}$ typically has a value of from 1 to 3, depending upon the particular application. At part 8 of the flow diagram, a new value of A, referred to here as the intermediate digital control number, is calculated as the sum of the previously calculated value of RPME and two times the value of LAG$\phi$. the remainder of part 8 operates to limit the values of A to those values of A that represent addresses within a predetermined, stored look-up table. In addition, if A exceeds 175, which would occur when the error in speed is large, the lag feedback term is reduced, i.e., LAG$\phi$ is replaced by LAG$\phi-1$, so that once the error in speed is moderated, there does not still remain a large value of LAG$\phi$ to be reduced by digital integration before the error in speed can be reduced to a small value.

Figure 7:
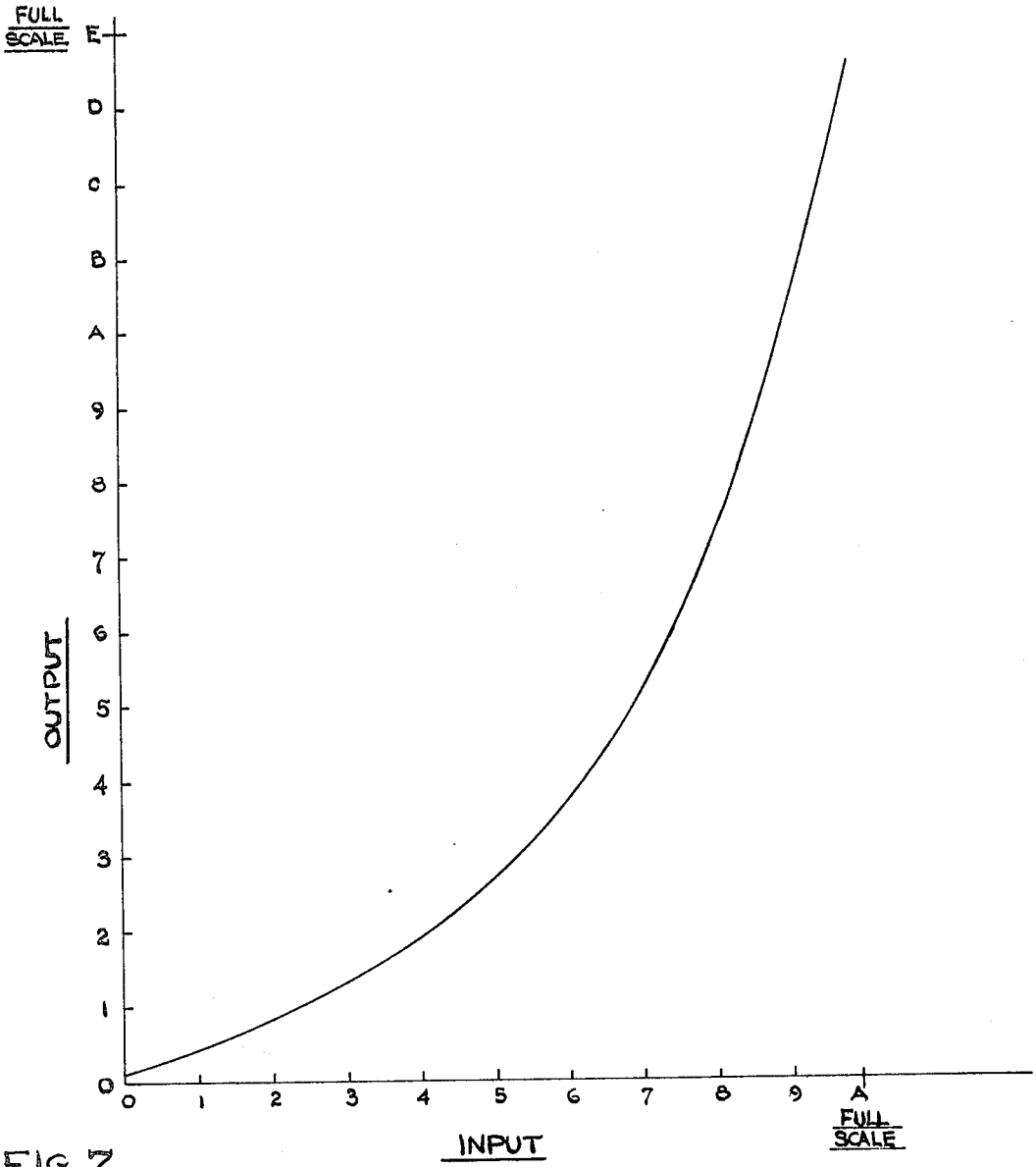
FIG. 7 is a graph of the nonlinear function stored in the look-up table.

At part 9 of the flow diagram, the value of A is used as an address within a stored look-up table of numbers to obtain NONLT(A), which numbers vary in a nonlinear fashion with respect to A. The values in a typical look-up table, such as that used in the preferred embodiment, are represented in FIG. 7. The nonlinear function in FIG. 7 compensates for the nonlinear relationship between the throttle butterfly valve position and the effect of the butterfly valve on engine operation. Small changes in butterfly throttle value position significantly affect engine operation when the butterfly valve is nearly closed and have relatively little effect on operation when the butterfly valve is nearly wide open. Accordingly, the slope of the curve is low for small values of A and large for large values of A so as to compensate, at least in part, for the nonlinear characteristics of the butterfly throttle valve.

The actuator command, ACTCMD, is given by the sum of the value obtained from the stored look-up table and ACTBYS, which is a constant representing the actuator position when the butterfly valve is closed. The maximum value of ACTCMD is limited to 225 so as not to exceed the operating range of the actuator.

Although a nonlinear, look-up table is used in the preferred embodiment, other means may be used to provide the nonlinear relationship between ACTCMD and A. For instance, ACTCMD may be defined in terms of a polynomial function of A. For each value of A, the polynomial would be used to calculate the corresponding value for ACTCMD. It should be apparent that portions 3–9 of the flow diagram perform the operations attributed to throttle actuator command generator 10.

The nonlinear operations on A in part 6 of the flow diagram, in effect, significantly increase the feedback gain of the control system whenever the speed of the engine has deviated significantly from the desired speed and this deviation is increasing. The increase in gain, in combination with the reduced response times for the lag network, causes the engine speed to be quickly corrected. By making A "0" and thus reducing the feedback gain when the error in engine speed is small, the system is caused to operate in a stable manner, while still being able to react abruptly whenever the engine speed is significantly in error.

Although in the application described here, the desired rpm was at any moment either of two values, idle or a higher fixed speed required to generate the welding current or to generate AC current at 60 Hz, this invention is not limited in its operation to controlling the engine at two fixed speeds. The rpm command generator 5 could be modified to be responsive to a continuously variable rpm demand sensor. For instance, if one of the rpm sensors were a potentiometer attached to an "accelerator", the analog output of the potentiometer could be converted to its digital equivalent in order to provide the rpm command generator with information from which it could generate the digital equivalent of a continously varying function representing the desired rpm. Thus, in general, the rpm command generator 5 operates in response to a number of operating environment sensors to generate an output representing the desired rpm.

We claim:

1. An improved apparatus for automatically controlling the speed of an engine in response to demand sensors and having an actuator controlled throttle and having rpm sensing means for sensing the actual speed of the engine, wherein the improvement comprises:

(a) rpm command generator means for determining the desired speed of the engine in response to the demand sensors;

(b) rpm error generator means, responsive to the outputs of the rpm command generator means and the rpm sensing means, for generating an output proportional to the difference between the desired speed and the actual speed of the engine;

(c) throttle actuator command generator means, responsive to the output of the rpm error generator means, for generating throttle actuator commands, comprising: (1) digital computational means, responsive to the output of the rpm error generator means, for generating an intermediate digital control number by a combination of digital processes that are approximately equivalent to a lag feedback network, the digital processes effectively having variable feedback components that are altered in magnitude in a step-wise manner responsive to the output of the rpm error generator means, and (2) nonlinear means, responsive to the intermediate digital control number, for generating throttle actuator commands, which throttle actuator commands are related in a predetermined, nonlinear manner to the intermediate digital control number;

(d) the throttle actuator being responsive to the throttle actuator commands.

2. An improved apparatus for automatically controlling the speed of an engine in response to demand sensors and having an actuator controlled throttle and having rpm sensing means for sensing the actual speed of the engine, wherein the improvement comprises:

(a) rpm command generator means for determining the desired speed of the engine in response to the demand sensors;

(b) rpm error generator means, responsive to the outputs of the rpm command generator means and the rpm sensing means, for generating an output proportional to the difference between the desired speed and the actual speed of the engine;

(c) throttle actuator command generator means, responsive to the output of the rpm error generator means, for generating throttle actuator commands, comprising: (1) digital computational means, responsive to the output of the rpm error generator means, for generating an intermediate digital control number by a combination of digital processes that are approximately equivalent to a combination of lead and lag feedback networks, the digital processes effectively having variable feedback components that are altered in magnitude in a step-wise manner responsive to the output of the rpm error generator means, and (2) nonlinear means, responsive to the intermediate digital control number, for generating throttle actuator commands, which throttle actuator commands are related in a predetermined, nonlinear manner to the intermediate digital control number;

(d) the throttle actuator being responsive to the throttle actuator commands.

3. The apparatus defined in claim 2 wherein the digital computational means for generating an intermediate digital control number comprises a digital computation means for performing a computational process that is approximately equivalent to a lead and a lag feedback network and wherein the time constant of the lag feedback network, in effect, is reduced to a low value when the desired engine speed less the actual engine speed exceeds the weighted output of the lead and lag networks by more than a predetermined threshold and the engine speed is decreasing, or when the engine speed, less the desired speed, is less than the weighted outputs of the lead and lag networks by more than a predetermined threshold and the engine speed is increasing, and the time constant of the lag network is maintained at a high number during all other engine operating conditions, and wherein the effective value of the feedback gain of the lead and lag networks is increased to a higher level whenever the absolute magnitude of the difference between the desired and the actual engine speed exceeds a predetermined threshold as compared to the level of the effective feedback gain when the absolute magnitude of the difference between the desired and the actual engine speed is less than said predetermined threshold.

4. The apparatus defined in claims 1, 2 or 3, wherein the nonlinear means comprises stored nonlinear look-up table means, responsive to the intermediate digital control number, for generating throttle actuator commands from a stored look-up table, which throttle actuator commands are related in a predetermined, nonlinear manner to the intermediate digital control number.

5. The apparatus defined in claims 1, 2 or 3 and additionally comprising:

(a) electrical generator means driven by the engine for generating welding current and alternating current power at 60 Hz;

(b) welding current sensor means, responsive to welding current output by the electrical generator means, for sensing and indicating when welding current is being drawn from the electrical generator means;

(c) AC current sensor means, responsive to the alternating current output by the electrical generator means at 60 Hz, for sensing and indicating when AC current at 60 Hz is being drawn from the electrical generator means;

(d) state switch means, responsive to operator control, for indicating whether the electrical generator means is being used for generating welding current or for generating AC current at Hz;

(e) the rpm command generator means being responsive to the output of the welding current sensor means, the AC current sensor means and the state switch means.

6. An improved method for automatically controlling the speed of an engine having an actuator controlled throttle and having rpm sensing means for sensing the actual speed of the engine wherein the improved method comprises:

(a) determining the desired speed of the engine;

(b) generating an rpm error representing the difference between the desired speed and the actual speed of the engine;

(c) generating throttle actuator commands in response to the rpm error by first generating an intermediate digital control number by a combination of digital processes that are approximately equivalent to a lag feedback network, the digital processes effectively having variable feedback components that are altered in magnitude in a stepwise manner responsive to the rpm error and, second, entering a nonlinear look-up table with the intermediate digital control number to obtain from the nonlinear look-up table the throttle actuator commands;

(c) controlling the throttle actuator in response to the throttle actuator commands.

7. An improved method for automatically controlling the speed of an engine having an actuator controlled throttle and having rpm sensing means for sensing the actual speed of the engine wherein the improved method comprises:

(a) determining the desired speed of the engine;

(b) generating an rpm error representing the difference between the desired speed and the actual speed of the engine;

(c) generating throttle actuator commands in response to the rpm error by first generating an intermediate digital control number by a combination of digital processes that are approximately equivalent to a lag feedback network, the digital processes effectively having variable feedback components that are altered in magnitude in a stepwise manner responsive to the rpm error and, second, calculating the throttle actuator command from a polynomial function of the intermediate digital control number;

(d) controlling the throttle actuator in response to the throttle actuator commands.

8. An improved method for automatically controlling the speed of an engine having an actuator controlled throttle and having rpm sensing means for sensing the actual speed of the engine wherein the improved method comprises:

(a) determining the desired speed of the engine;

(b) generating an rpm error representing the difference between the desired speed and the actual speed of the engine;

(c) generating throttle actuator commands in response to the rpm error by first generating an intermediate digital control number by a combination of digital processes that are approximately equivalent to a combination of lead and lag feedback networks, the digital processes effectively having variable feedback components that are altered in magnitude in a stepwise manner responsive to the rpm error and, second, entering a nonlinear look-up table with the intermediate digital control number to obtain from the nonlinear look-up table the throttle actuator commands;

(d) controlling the throttle actuator in response to the throttle actuator commands.

9. An improved method for automatically controlling the speed of an engine having an actuator controlled throttle and having rpm sensing means for sensing the actual speed of the engine wherein the improved method comprises:

(a) determining the desired speed of the engine;

(b) generating an rpm error representing the difference between the desired speed and the actual speed of the engine;

(c) generating throttle actuator commands in response to the rpm error by first generating an intermediate digital control number by a combination of digital processes that are approximately equivalent to a combination of lead and lag feedback networks, the digital processes effectively having variable feedback components that are altered in magnitude in a stepwise manner responsive to the rpm error and, second, calculating the throttle actuator command from a polynomial function of the intermediate digital control number;

(d) controlling the throttle actuator in response to the throttle actuator commands.

* * * * *